US010485343B2

(12) United States Patent
Clark

(10) Patent No.: US 10,485,343 B2
(45) Date of Patent: Nov. 26, 2019

(54) REPLACEABLE FURNITURE BASE

(71) Applicant: Norman L. Clark, Greeneville, TN (US)

(72) Inventor: Norman L. Clark, Greeneville, TN (US)

( * ) Notice: Subject to any disclaimer, the term of this patent is extended or adjusted under 35 U.S.C. 154(b) by 159 days.

(21) Appl. No.: 15/660,132

(22) Filed: Jul. 26, 2017

(65) Prior Publication Data

US 2019/0029421 A1 Jan. 31, 2019

(51) Int. Cl.
*A47B 91/00* (2006.01)

(52) U.S. Cl.
CPC ..... *A47B 91/005* (2013.01)

(58) Field of Classification Search
USPC ..... 248/346.01, 346.07
See application file for complete search history.

(56) References Cited

U.S. PATENT DOCUMENTS 2,698,152 A * 12/1954 Kaye ..... A47B 45/00 248/149
5,180,134 A * 1/1993 Mallak ..... B65G 7/02 108/55.1
5,308,037 A * 5/1994 Gonzalez ..... F24F 13/32 248/670
6,155,527 A * 12/2000 Muyskens ..... B65D 19/0002 108/51.3
6,192,807 B1 * 2/2001 Mason ..... B65D 19/0002 108/27
6,820,850 B2 * 11/2004 Coleman ..... B65D 19/0002 248/346.06
7,028,964 B2 4/2006 Baechle
7,805,781 B1 10/2010 Smith
7,988,236 B2 8/2011 Brandtner
8,205,281 B2 6/2012 Swierski et al.
D663,557 S 7/2012 Marler
8,465,101 B1 6/2013 Alvarez
8,763,972 B2 * 7/2014 Turschel ..... B60N 2/01558 211/162
9,016,212 B2 * 4/2015 Valiulis ..... G09F 23/06 108/27
2005/0103964 A1 5/2005 Baechle
2007/0051863 A1 * 3/2007 Froeschner ..... B29C 33/0011 248/346.01
2009/0146040 A1 6/2009 Small
2009/0174248 A1 7/2009 Chisholm
2011/0209838 A1 9/2011 Santora
2012/0315434 A1 12/2012 Marler et al.

* cited by examiner

*Primary Examiner* — Monica E Millner
(74) *Attorney, Agent, or Firm* — Pitts & Lake, P.C.

(57) ABSTRACT

A replaceable furniture base that can be quickly and easily replaced in whole or in part when the furniture base shows signs of excessive wear or damage.

7 Claims, 4 Drawing Sheets

REPLACEABLE FURNITURE BASE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to replaceable furniture bases, and more particularly, to a furniture base that can be quickly and easily replaced in whole or in part when the furniture base shows signs of excessive wear or damage.

2. Description of the Related Art

Articles of furniture are typically manufactured with a permanent furniture base that supports the article of furniture. Shoes, vacuum cleaners, carpet cleaners and other items often impact the furniture base resulting in scuff marks, scratches, dents and other signs of wear or damage. Many modifications of furniture bases have been developed over the years. Although modified furniture bases may be adequate for some purposes, such as keeping articles out from under the furniture, such modified furniture bases have not been designed to be quickly and easily detached and replaced upon signs of wear or damage. The furniture base described below fulfills this need. More specifically, the replaceable furniture base of the present invention assists in preventing common damage to commercial furniture in the hospitality industry. This includes water damage that is common in this market due to carpet cleaning, AC units leaking and customer spills. This replacement base unit allows the renewal of the furniture for a very reasonable cost.

BRIEF SUMMARY OF THE INVENTION

The present general inventive concept provides a replaceable furniture base that may be integrated into the manufacture of new furniture or retrofitted to existing furniture. Once installed under an article of furniture, the whole base or any part of the base may be quickly removed and replaced upon signs of wear or damage.

According to one embodiment of the present invention, the replaceable furniture base consists of: (1) two substantially similar side panels for the left-side panel and the right-side panel with each of the side panels having opposing end portions, which side panels are situated parallel to each other, (2) two substantially similar panels for the front panel and the back panel with each of the panels having opposing end portions, which panels are situated parallel to each other and perpendicular to and outside of the side panels, (3) a plurality of detachable connectors configured to demountably attach adjacent end portions of the panels to each other to form the furniture base, and (4) a plurality of detachable connectors configured to demountably attach each of the panels of the furniture base to an article of furniture.

In some embodiments, the detachable connectors for attaching two panels of the furniture base together is a 90-degree angle bracket configured with at least one hole in each section of the angle bracket for receiving at least one screw to secure one section of the angle bracket to the end portion of one of the panels and for receiving at least one screw to secure the other section of the angle bracket to the end portion of the adjacent panel.

In some embodiments, the detachable connectors for attaching the furniture base to the article of furniture is a detachable 90-degree angle bracket configured with at least one hole in each section of the angle bracket for receiving at least one screw to secure one section of the angle bracket to the panel and for receiving at least one screw to secure the other section of the angle bracket to the article of furniture.

In some embodiments, the detachable connectors for attaching panels of the furniture base together and the detachable connectors for attaching the furniture base to the article of furniture are substantially similar making all of the detachable connectors interchangeable.

In another embodiment of the present inventive concept, the replaceable furniture base for an article of furniture comprising consists of: (1) a left member configured with a plurality of connectors for demountably attaching the left member to an article of furniture; and (2) a right member configured with a plurality of connectors for demountably attaching the right member to an article of furniture.

In one embodiment, the connectors for demountably attaching the members of the furniture base to an article of furniture is a plurality of tabs integrated into the top of each member, with each tab configured to be perpendicular to the member with at least one hole in each tab for receiving at least one screw for securing the member to the article of furniture.

In some embodiments, each member of the furniture base is configured with relief cuts at the top of the area where the two members overlap to accommodate the connecting tabs of the overlapping member.

In some embodiments, two members of the furniture base are configured to slide past each other at the front of the furniture base to adjust the width of the furniture base to fit the width of the article of furniture.

In some embodiments, each member of the furniture base is secured to the article of furniture and held in place solely by the screws inserted through the connecting tabs of the member and piercing the article of furniture, with the two members touching each other at the overlapping area, but not fastened to each other.

In some embodiments, each member of the furniture base is secured to the article of furniture and held in place solely by the screws inserted through the connecting tabs of the member and piercing the article of furniture, but with the two members not touching each other at the overlapping area and with the two members not fastened to each other.

Other features and aspects may be apparent from the following detailed description, the drawings, and the claims.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Reference will now be made to various example embodiments of the present general inventive concept, examples of which are illustrated in the accompanying drawings and illustrations.

Figure 1A:
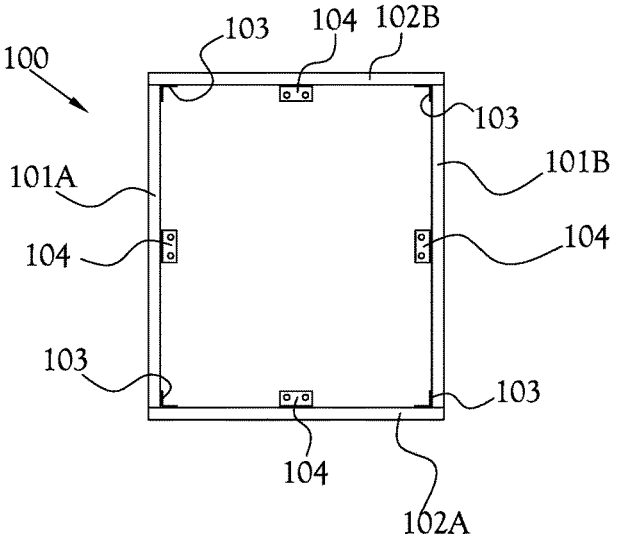
FIG. 1A is a top view of an example embodiment of the present general inventive concept with the panels of the furniture base connected by angle brackets and with substantially similar angle brackets shown for later attachment of the furniture base to an article of furniture.
Figure 1B:
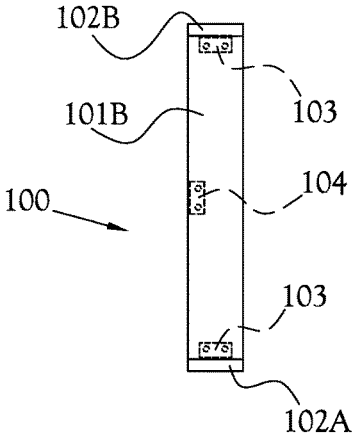
FIG. 1B is a side view of an example embodiment of the present general inventive concept with the panels of the furniture base connected together by angle brackets and with substantially similar angle brackets shown for later attachment of the furniture base to an article of furniture.
Figure 1C:
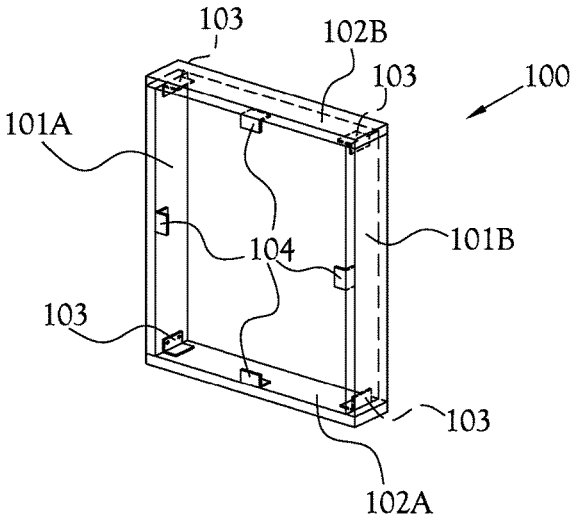
FIG. 1C illustrates a perspective view of an example embodiment of the present general inventive concept with the panels of the furniture base connected by angle brackets and with substantially similar angle brackets shown for later attachment of the furniture base to an article of furniture.

FIG. 1A is a top view, FIG. 1B is a side view and FIG. 1C is a perspective view of an example embodiment of a replaceable furniture base with the panels of the furniture base connected by angle brackets, and with substantially similar angle brackets shown for later attachment of the replaceable furniture base to an article of furniture Referring to FIGS. 1A, 1B and 1C, the replaceable furniture base 100 is comprised of: (1) two substantially similar panels for the left-side panel 101A and the right-side panel 101B with each of the side panels 101A,101B having opposing end portions, which side panels 101A,101B are situated parallel to each other, (2) two substantially similar panels for the front panel 102A and the back panel 102B with each of the panels 102A,102B having opposing end portions, which panels 102A,102B are situated parallel to each other and perpendicular to and outside of the side panels 101A, 101B, (3) a plurality of detachable connectors configured to demountably attach adjacent end portions of the panels 101A, 101B, 102A, 102B to form the furniture base 100, and (4) a plurality of detachable connectors configured to demountably attach each of the panels of the furniture base 100 to an article of furniture 300.

Referring to FIGS. 1A, 1B and 1C, each of the side panels 101A, 101B, of the furniture base 100 is an elongated rectangular panel having a top, a bottom, a left side, a right side, a front end portion terminating in a front end, and a back end portion terminating in a back end. Each of the front panel 102A and the back panel 102B of the furniture base 100 is an elongated rectangular panel having a top, a bottom, a front, a back, a left end portion terminating in a left end, and a right end portion terminating in a right end. The panels 101A, 101B, 102A, 102B may be composed of wood, plastic, metal, fiberglass, or another rigid material, or a combination thereof. In one embodiment, the panels 101A, 101B, 102A, 102B are made of wood cut from a wood board 4 inches tall and one inch wide. In some embodiments, the length of the front panel 102A and the back panel 102B is equal to the width of the article of furniture 300 to which the furniture base 100 will be attached. In some embodiments, the length of the left-side panel 101A and the right-side panel 101B is two inches (twice the thickness of the board) less than the depth of the article of furniture 300. This permits the edges of the front panel 102A and the back panel 102B to extend flush to the outer edge of the side panels 101A, 101B so that no seam shows on the front of the assembled furniture base 100 and permits the furniture base 100 to extend flush to the front edge and back edge of the article of furniture 300. In other embodiments, a recess from the front edge of the article of furniture 300 in front of the furniture base 100 may be desired to form a kick space under the front of the article of furniture 300. If a kick space is desired, the side panels 101A, 101B may be shortened by the depth of the desired kick space. In some embodiments, the length of the front panel 102A and the back panel 102B may be shortened to recess the side panels 101A, 101B back from the side edges of the article of furniture 300, and the length of the side panels 101A, 101B may be shortened to recess the back panel 102B from the back edge of the article of furniture 300.

One skilled in the art will recognize that the composition of the panels 101A, 101B, 102A, 102B is not critical to the present general inventive concept. Likewise, one skilled in the art will recognize that the specific measurements of the panels 101A, 101B, 102A, 102B in the example embodiment are not critical to the present general inventive concept. Further, one skilled in the art will recognize that the specific placement of the panels 101A, 101B, 102A, 102B in the example embodiment is not critical to the present general inventive concept. Accordingly, materials other than wood and in a variety of sizes can be readily substituted in forming the panels 101A, 101B, 102A, 102B, and the panels 101A, 101B, 102A, 102B may be recessed from the edges of the article of furniture 300 without departing from the scope or spirit of the present general inventive concept.

Figure 1D:
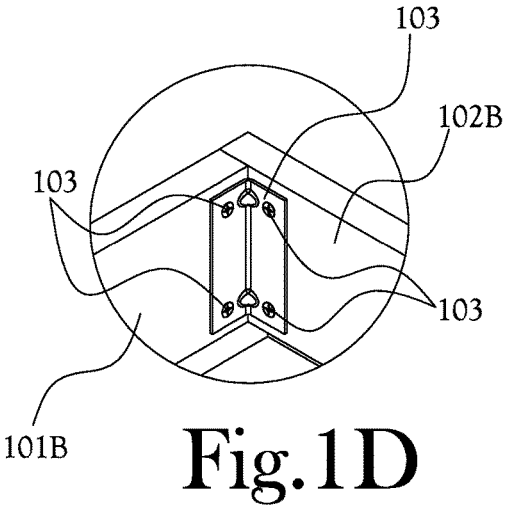
FIG. 1D is a perspective view of an example embodiment of angle brackets and wood screws securing two panels of the furniture base to each other.

In some embodiments of the current invention the detachable connectors for assembling the panels 101A, 102A, 101B, 102B into the furniture base 100 is a 90-degree angle bracket configured with at least one hole in each section of the angle bracket for receiving at least one screw to secure one section of the angle bracket to the end portion of one of the panels 101A, 102A, 101B, 102B of the furniture base 100 and for receiving at least one screw to secure the other section of the angle bracket to the end portion of the adjacent panel of the furniture base 100. Referring to FIG. 1D, the detachable connectors for demountably attaching the panels 101A, 102A, 101B, 102B of the furniture base 100 to each other to form the furniture base 100 are comprised of 90-degree angle brackets 103 configured with two holes in each section of the angle bracket. In this example embodiment, the left-side panel 101A and the front panel 102A are secured to each other by: (1) recessing the left-side panel 101A behind the front panel 102A with the left side of the left-side panel 101A flush with the left end of the front panel 102A; (2) placing the angle bracket 103 midway on the panels 101A, 102A from top to bottom inside the 90-degree angle where the two panels 101A, 102A meet, with one section of the angle bracket 103 flush against the back of the front panel 102A and the other section of the angle bracket 103 flush against the right side of the left-side panel 101A; (3) inserting a wood screw 105 through each hole in the side of the angle bracket 103 that is in contact with the front panel 102A and piercing into the wood of the front panel 102A; and (4) inserting a wood screw 105 through each hole in the other side of the angle bracket 103 that is in contact with the left-side panel 101A and piercing into the wood of the left-side panel 101A. FIG. 1D is a perspective view of the angle bracket 103 with wood screws 105 securing the angle bracket 103 to a portion of the left-side panel 101B and a portion of the back panel 102B. In essentially the same manner, the right-side panel 101B is attached to the front panel 102A, the left-side panel 101A is attached to the back panel 102B, and the left-side panel 101A is attached to the front panel 102A to form the furniture base 100.

Figure 2:
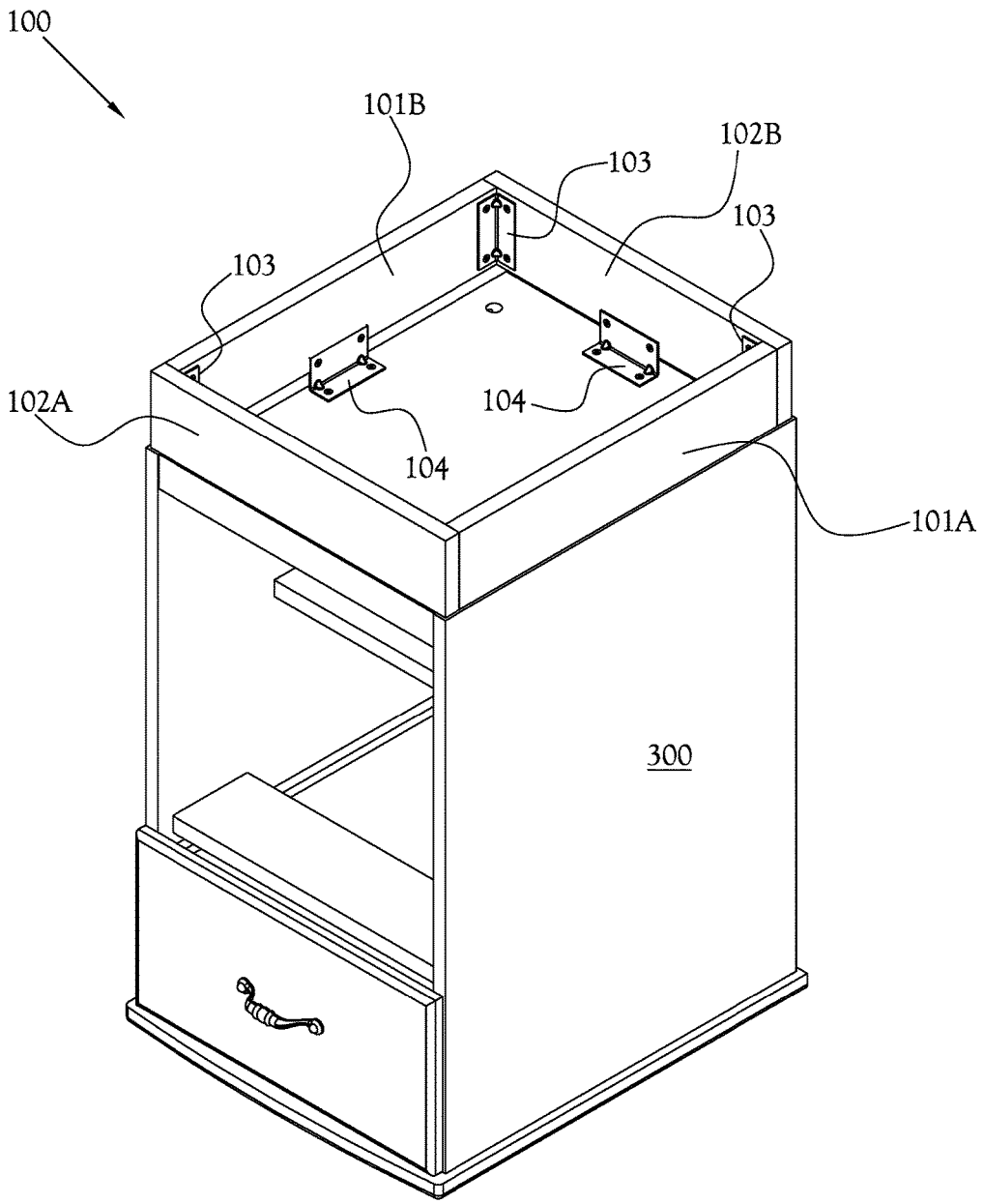
FIG. 2 is a perspective view of an upside-down article of furniture with an example embodiment of the present general inventive concept attached to the bottom of the article of furniture to serve as its furniture base.

In some embodiments, the detachable connectors for attaching the furniture base 100 to the article of furniture 300 is a 90-degree angle bracket configured with at least one hole in each section of the angle bracket 104 for receiving at least one screw to secure one section of the angle bracket 104 to one of the panels 101A, 101B, 102A, 102B and for receiving at least one screw to secure the other section of the angle bracket to the article of furniture 300. Still referring to the example embodiment of the invention depicted in FIGS. 1A, 1B and 1C, the detachable connectors for demountably attaching the furniture base 100 to the article of furniture 300 are comprised of 90-degree mounting brackets 104 configured with two holes in each section of the angle bracket 104. In this example embodiment, the angle bracket 104 is secured to the front panel 102A by: (1) centering the angle bracket from left to right on the back side of the front panel 102A with the section of the angle bracket 104 not in contact with the front panel 102A positioned flush with the top of the front panel 102A with the holes of the non-contacting section of the angle bracket 104 positioned toward the back of the furniture base 100; and (2) inserting wood screws 105 through the holes of the side of the angle bracket that is in contact with the front panel 102A and piercing into the wood of the front panel 102A. In essentially the same manner and position, an angle bracket 104 is attached with wood screws 105 to the left-side panel 101A, the right-side panel 101B, and the back panel 102B, with the holes of the non-contacting section of the angle bracket 104 positioned toward the center of the furniture base 100. The assembly of the furniture base 100 is now complete and ready for attachment to the bottom of the article of furniture 300. Referring to FIG. 2, in the current embodiment of the invention, the furniture base 100 is placed upside down on the bottom of the article of furniture 300 and attached to the article of furniture 300 by inserting wood screws 105 through the holes of the side of each angle bracket 104 that is in contact with the article of furniture 300 and piercing into the wood of the article of furniture 300.

In some embodiments, the detachable connectors for attaching panels 101A, 101B, 102A, 102B of the furniture base 100 together and the detachable connectors for attaching the furniture base 100 to the article of furniture 300 are substantially similar making all of the detachable connectors interchangeable. Referring to FIGS. 1A, 1B and 1C, the angle brackets 103 for attaching panels 101A, 101B, 102A, 102B of the furniture base 100 together and the angle brackets for attaching the furniture base 100 to the article of furniture 300 are substantially similar and are interchangeable.

Those skilled in the art will recognize that the detachable connectors may be configured in other ways and sizes to hold the apparatus together without departing from the spirt and scope of the present invention.

Figure 3A:
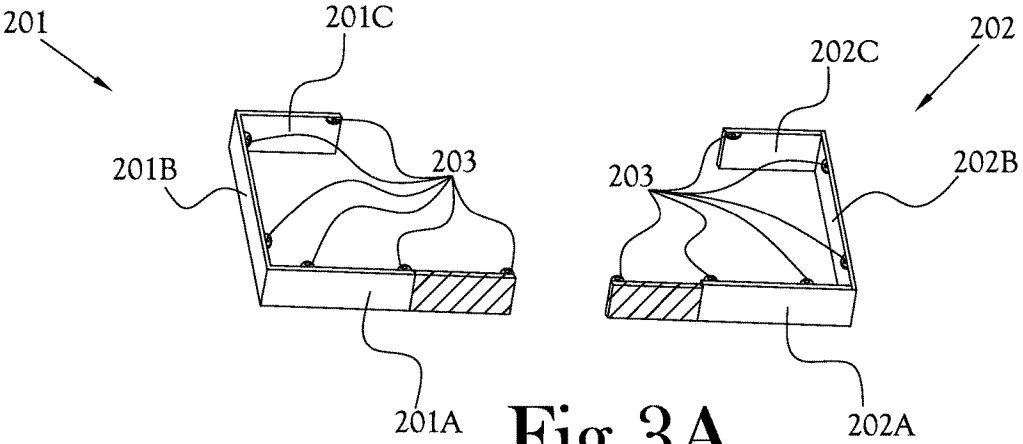
FIG. 3A is an exploded diagram of another example embodiment of the furniture base depicting the two members of the furniture base with hatched areas to indicate the potential overlap areas of the two members.
Figure 3C:
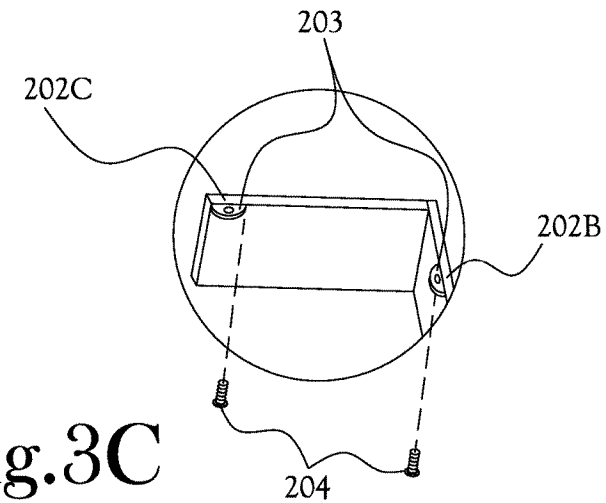
FIG. 3C is a perspective view of an example embodiment of a connecting tab and a perspective view of a wood screw for securing the members of the furniture base to an article of furniture.
Figure 3B:
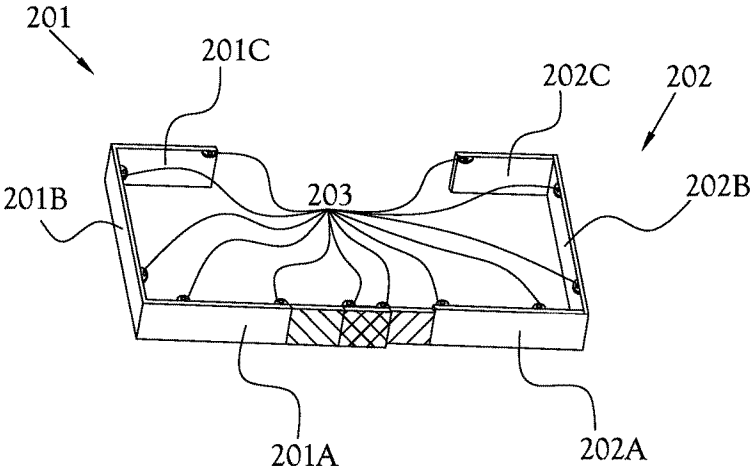
FIG. 3B is a perspective view of another example embodiment of the furniture base depicting the two members of the furniture base positioned together with a cross-hatched area to show where the members overlap when adjusted to fit an article of furniture.

FIG. 3A is a perspective view showing the two separate members of the furniture base 200, and FIG. 3B is a perspective view of another embodiment of the replaceable furniture base depicting a furniture base 200 fully assembled. Referring to FIGS. 3A and 3B, the replaceable furniture base 200 is comprised of: (1) a left member 201 having a front panel 201A, a side panel 201B, a back panel 201C, and a plurality of connecting tabs 203 attached at intervals along the top of the panels 201A, 201B and 201C, and (2) a right member 202 having a front panel 202A, a side panel 202B, a back panel 202C, and a plurality of connecting tabs 203 attached at intervals along the top of the panels 202A, 202B and 202C. The width of the furniture base 200 can be adjusted by sliding the distal end of the front panel 201A of the left member 201 past the distal end of the front panel 201B of the right member 202 resulting in an overlapping area for the two members 201, 202. Referring to FIG. 3A, the potential overlapping area of the front panel 201A is the area that is hatched with parallel lines slanting to the right from top to bottom, and the potential overlapping area of the front panel 202A is the area that is hatched with parallel lines slanting to the left from top to bottom. Referring to FIG. 3B, the area where the two members 201, 202 overlap is cross-hatched.

In one embodiment of the replaceable furniture base 200 depicted in FIGS. 3A and 3B, the left member 201 may be configured by: (1) cutting a four-inch wide by one-quarter inch thick metal bar to the desired length, (2) with the metal bar resting on its one-quarter inch width and positioned with its length pointing to the back, bending the back section of the metal bar 90 degrees to the right to form the back panel 201C and bending the front section of the metal bar 90 degrees to the right to form the front panel 201A, leaving the center section of the metal bar as the side panel 201B, (3) cutting a one-half inch diameter semicircle from a one-eighth inch thick piece of sheet metal and drilling a three-sixteenths inch hole into the semicircle, with the hole located mid-way between the edges of the semicircle along both the horizontal axis and the vertical axis to form the connecting tabs 203, and (4) welding the connecting tabs 203 at intervals along the tops of the panels 201A, 201B, 201C at a 90 degree angle from the sides of the panels 201A, 201B, 201C, with the top of the connecting tabs 203 placed flush with the tops of the panels 201A, 201B, 201C, and with the connecting tabs 203 pointed toward the inside of the assembled furniture base 200.

In one embodiment, a metal bar is cut to a length of 22 inches, which is then bent to form an 11-inch front panel 201A, a 16-inch side panel 201B, and a 6-inch back panel 201C, with a potential overlap area of five inches at the distal end of the front panel 201A. In one embodiment, the connecting tabs 203 are located as follows: (1) at the top of front panel 201A, one connecting tab 203 located at the distal end of the front panel 201A, one connecting tab 203 located proximate to the inner limit of the overlapping area of the front panel 201A, and one connecting tab 203 located two inches from the bend separating the front panel 201A from the side panel 201B, (2) at the top of the side panel 201B, one connecting tab 203 located four inches from the front of the side panel 201B and another connecting tab 203 located four inches from the back of the side panel 201B, and (3) at the top of the back panel 201C, one connecting tab 203 located at the distal end of the back panel 201C.

In the embodiment of the replaceable furniture base 200 depicted in FIGS. 3A and 3B, the right member 202 is configured in a similar manner to mirror the left member 201. The lengths of the panels 202A, 202B, 202C and the location of the connecting tabs 203 for the right member 202 are configured to mirror those of the left member 201. Although the configurations of the left member 201 and the right member 202 are similar, an additional step is performed to the right member 202 by cutting one-eighth inch from the top of the right panel 202A between the two connecting tabs 203 that are proximate to the potential overlap area shown as hatched in FIG. 3A. This allows the connecting tab at the distal end of the front panel 201A to fit over the top of the front panel 202A where the left member 201 overlaps the right member 202. In some embodiments, in lieu of cutting a one-eighth inch cut at the top of the entire potential overlap area on the front panel 202A, a plurality of cuts one-eighth inch deep and slightly wider than the connecting tabs 203 will be spaced at intervals along the top of the potential overlap area on the front panel 202A for receipt of the connecting tab 203 at the distal end of the front panel 201A through one of the cuts. The specific cut receiving the connecting tab 203 at the distal end of the front panel 201A will depend on the desired width of the furniture base.

One skilled in the art will recognize that the specific measurements of the panels 201A, 201B, 201C, 202A, 202B, 202C in the example embodiment, the size of the potential overlap areas of the front panels 201A, 201B, the specific quantity, location and size of the cuts for receipt of the connecting tab 203, and the specific quantity, location, size and hole-size of the connecting tabs 203 at intervals along the top of the panels 201A, 201B, 201C, 202A, 202B, 202C are not critical to the present general inventive concept so long as the connecting tabs 203 are sufficient to securely attach the furniture base 200 to the article of furniture 400. Accordingly, a variety of panel sizes with different sized potential overlap areas and with different quantities, sizes and location of the connecting tabs and with different quantities, sizes and location of cuts for receipt of the connecting tabs can be readily substituted for those described above without departing from the scope or spirit of the present general inventive concept.

Figure 4:
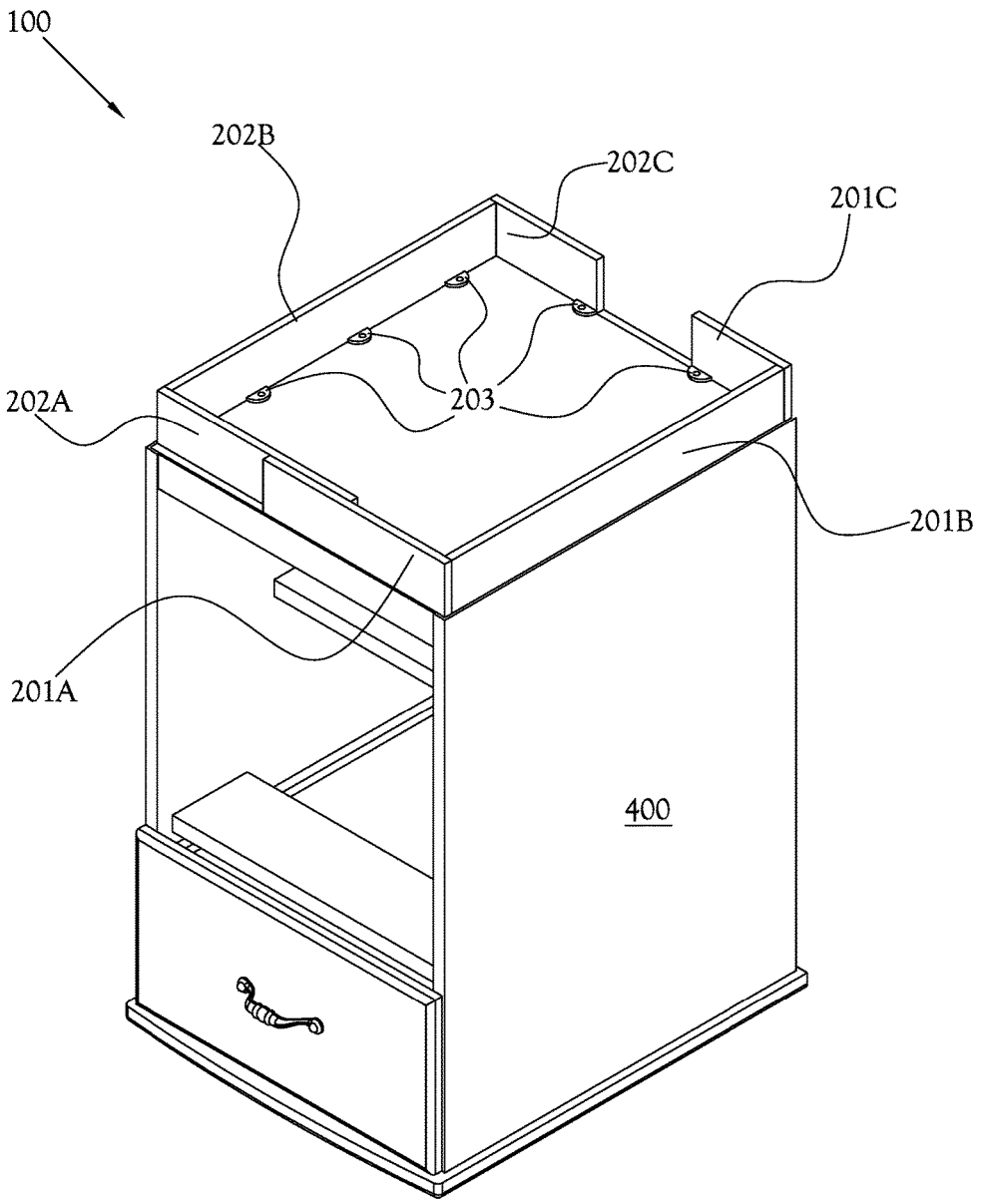
FIG. 4 is a perspective view of an upside-down article of furniture with an example embodiment of the present general inventive concept attached to the bottom of the article of furniture to serve as its furniture base.

Referring to FIG. 4, in the current embodiment of the invention, the two members 201, 202 of the furniture base 200 are placed upside-down on the bottom of the upside-down article of furniture 400. Facing the front of the upside-down article of furniture 400, the left member 201 is placed to the right with the front panel 201A toward the front of the article of furniture 400, and the right member 202 is placed to the left with the front panel 202A toward the front of the article of furniture 400. The two members 201, 201 are pushed toward each other until adjusted to the width of the article of furniture, with the front of the front panel 202A touching the back of the front panel 201A in the overlapping area, and with the connecting tabs of the front panel 201A fitting under the cut-out area of the front panel 202A along the overlapping area. If a kick space is desired under the front of the article of furniture, the two members 201, 202 are pushed toward the back of the article of furniture 400 the distance of the desired kick space. Referring to FIG. 3C, the two members 201, 202 of the furniture base 200 are then secured to the article of furniture 400 by inserting a wood screw 204 through the hole of each connecting tab 203 and piercing into the wood of the article of furniture 400. In some embodiments, the two members 201, 202 will be in contact each other while, in other embodiments, the two members 201, 202 will not be contact with each other. Whether the two members 201, 202 are in contact with each other or not, no connection between or coupling of the two members 201, 202 is required to stabilize the furniture base 200.

One skilled in the art will recognize that the composition of the two members 201, 202 is not critical to the present general inventive concept. In some embodiments present inventive concept, the two members 201, 202 including integral connecting tabs 203 may be cut from a sheet of steel, aluminum or another metal and the 90 degree bends performed on the two members 201, 202 to form the panels 201A, 201B, 201C, 202A, 202B, 202C. The connecting tabs 203 can be bent downward 90 degrees toward the inside of the furniture base 200 for later attachment to the article of furniture 400.

In some embodiments of the present invention, the two members 201, 202 of the furniture base 200 may be formed by pouring molten metal, plastic or another material into a mold configured to form the members 201, 202, including the 90 degree connecting tabs 203 and the cut-out area at the top of the front panel 202A of the right member 202.

While the present general inventive concept has been illustrated by description of several embodiments and while the illustrative embodiments have been described in considerable detail, it is not the intention of the applicant to restrict or in any way limit the scope of the appended claims to such detail. Those skilled in the art will recognize that the replaceable furniture base may be configured by substituting a variety of materials and may be configured in a variety of styles and sizes without departing from the scope or spirit of the present general inventive concept. Additional modifications will readily appear to those skilled in the art. In manufacturing the apparatus, the edges where surfaces meet may be arcuate instead of being square as depicted. The general inventive concept in its broader aspects is therefore not limited to the specific materials, dimensions, edge finishes, details, fasteners, tabs, methods, and illustrative examples shown and described. Accordingly, departures may be made from such details without departing from the spirit or scope of applicant's general inventive concept.

What is claimed is:

1. A replaceable furniture base for an article of furniture, comprising:

two substantially similar side panels for the left-side panel and the right-side panel with each of the side panels having opposing end portions, which side panels are situated parallel to each other;

two substantially similar panels for the front panel and the back panel with each of the panels having opposing end portions, which panels are situated parallel to each other and perpendicular to and outside of the side panels;

a plurality of first detachable connectors configured to demountably attach adjacent end portions of the panels to each other to form the furniture base; and a plurality of second detachable connectors configured to demountably attach each of the panels of the furniture base to an article of furniture, the second detachable connectors arranged such that portions thereof configured to demountably attach to the article of furniture extend inwardly from the panels so as to be attached to a bottom surface of the article of furniture;

wherein the furniture base is arranged such that the bottom surface of the article of furniture rests on top surfaces of all of the panels when attached to the furniture base.

2. The furniture base of claim 1, wherein the first detachable connectors for attaching two panels of the furniture base together are 90-degree angle brackets configured with at least one hole in each section of the angle bracket for receiving at least one screw to secure one section of the angle bracket to the end portion of one of the panels and for receiving at least one screw to secure the other section of the angle bracket to the end portion of the adjacent panel.

3. The furniture base of claim 1, wherein the second detachable connectors for attaching the furniture base to the article of furniture are detachable 90-degree angle brackets configured with at least one hole in each section of the angle bracket for receiving at least one screw to secure one section of the angle bracket to the panel and for receiving at least one screw to secure the other section of the angle bracket to the article of furniture.

4. The furniture base of claim 1, wherein the first detachable connectors for attaching two panels of the furniture base together and the second detachable connectors for attaching the furniture base to the article of furniture are substantially similar such that all of the first and second detachable connectors are interchangeable.

5. A method of demountably attaching a replaceable furniture base to an article of furniture comprising:

demountably attaching a front panel, a left-side panel, a back panel, and a right-side panel to form the furniture base using a plurality of first detachable connectors;

demountably attaching a plurality of second detachable connectors respectively to each of the panels such that portions thereof configured to demountably attach to the article of furniture extend inwardly from the panels so as to be attached to a bottom surface of the article of furniture; and demountably attaching the furniture base to an article of furniture using the plurality of second detachable connectors such that the bottom surface of the article of furniture rests on top surfaces of the panels.

6. The method of claim 5, wherein the first detachable connectors for attaching panels of the furniture base together and the second detachable connectors for attaching the furniture base to the article of furniture are substantially similar such that all of the first and second detachable connectors are interchangeable.

7. The furniture base of claim 1, wherein the portions of the second detachable connectors configured to demountably attach to the article of furniture are configured to be substantially flush with the top surfaces of the respective side panels.

* * * * *